United States Patent [19]

Arlauskas

[11] 4,412,695

[45] Nov. 1, 1983

[54] SLIDE BOLT LATCH ASSEMBLY

[75] Inventor: Alfonsas Arlauskas, Troy, Mich.

[73] Assignee: General Motors Corporation, Detroit, Mich.

[21] Appl. No.: 224,312

[22] Filed: Jan. 12, 1981

[51] Int. Cl.[3] ..... E05C 1/12

[52] U.S. Cl. ..... 292/173

[58] Field of Search ..... 292/173, 191, 192, 335

[56] References Cited

U.S. PATENT DOCUMENTS

| | | | |
|---|---|---|---|
| 466,008 | 12/1891 | Monroe | 292/173 |
| 1,437,785 | 12/1922 | Teich | 292/191 X |
| 1,869,274 | 7/1932 | Phillips . | |
| 2,207,569 | 7/1940 | Wild | 292/173 X |
| 2,322,817 | 6/1943 | Borchere | 292/191 X |
| 2,515,560 | 7/1950 | Lickteig | 292/173 X |
| 3,362,740 | 1/1968 | Burns | 292/34 |
| 3,582,120 | 6/1971 | Doett et al. . | |

*Primary Examiner*—Richard E. Moore

*Attorney, Agent, or Firm*—Patrick M. Griffin

[57] ABSTRACT

A slide bolt latch assembly includes a cam lever pivotally movable between a retracted position within the lower free swinging corner of a vehicle door and an extended position extending out of the door. A pin and slot connect the cam lever to a slide bolt for concurrent movement along a linear path between extended and retracted positions. A spring continually biases the cam lever and slide bolt to their extended positions. Movement of the door toward partially closed position engages the cam lever with the leading edge of a body mounted striker plate to move the cam lever and slide bolt to their retracted positions against the force of the spring. Final closing of the door disengages the cam lever from the leading edge of the striker plate. The spring returns the cam lever and slide bolt to extended position to engage the slide bolt with another edge of the plate and retain the door in closed position. A release lever is accessible from inside the vehicle to move the cam lever and the slide bolt to their retracted positions and allows the door to be opened.

3 Claims, 8 Drawing Figures

SLIDE BOLT LATCH ASSEMBLY

BACKGROUND OF THE INVENTION

This invention relates to a slide bolt latch assembly, specifically to a slide bolt latch assembly for the door of a vehicle such as a van.

DESCRIPTION OF THE PRIOR ART

In a vehicle such as a van with a pair of overlapping rear doors, upper and lower latch assemblies are generally used to latch the free swinging upper and lower corners of the first closed door to the roof rail and sill of the vehicle. It is desirable that the floor of the vehicle be kept flat with no projections and that the latch assemblies be operable to slam latch the first closed door without requiring the use of a handle. Such latch assemblies conventionally include a slide bolt having a wedge shaped end which engages a striker and is cammed against the force of a biasing spring to a retracted position within the door as the door is closed. When the door is fully closed, the biasing spring drives the bolt to an extended position within a slot in the striker plate or behind a rib on the vehicle, such as shown in Phillips U.S. Pat. No. 1,869,274 or Doerr et al. U.S. Pat. No. 3,582,120. Since the wedge shaped bolts must be strong enough to withstand slamming of the door and wide enough to provide sufficient lift during retraction, they are inherently thick and heavy.

SUMMARY OF THE INVENTION

The present invention provides a light slide bolt latch assembly for the first closed rear door of a van. The latch assembly may be used in place of one or both conventional slide bolt latch assemblies. In its preferred embodiment, the assembly includes a frame mounted inside a free swinging corner of the door. A cam lever is pivotally mounted to the frame for movement between a retracted position and an extended position. The cam lever is coupled to a slide bolt which moves concurrently therewith along a linear path between a retracted and an extended position. Guide slots on the frame guide the slide bolt. A stop means on the slide bolt engages the frame and limits the extending movement of both the slide bolt and the cam lever under the force of a biasing spring to locate both the cam lever and slide bolt in their extended positions. A manual release lever pivoted to the frame is engageable with the cam lever to rotate it and concurrently move the slide bolt to retracted position against the force of the biasing spring.

When the door is in closed position, the cam lever and slide bolt are in extended position and the slide bolt engages a striker to latch the door. When it is desired to open the door, the manual release lever is operated to move both the cam lever and slide bolt to retracted position to unlatch the door and permit it to be opened. When the release lever is released, the biasing spring returns both the cam lever and slide bolt to extended position. As the door is closed, the cam lever engages the leading edge of the striker and is thereby moved to retracted position as it concurrently moves the slide bolt to retracted position. The cam lever disengages from the striker as the door reaches fully closed position, and the biasing spring moves the cam lever and slide bolt to extended position wherein the latch bolt engages the striker to maintain the door in closed position.

Thus, this invention provides a slide bolt latch assembly for a vehicle door having a rotatable cam lever and a coupled, linear slide bolt. Both the cam lever and the slide bolt are of much thinner material than a conventional slide bolt.

BRIEF DESCRIPTION OF THE DRAWINGS

The structure and operation of the invention will appear from the following specification and drawings in which.

DESCRIPTION OF THE PREFERRED EMBODIMENT

Figure 1:
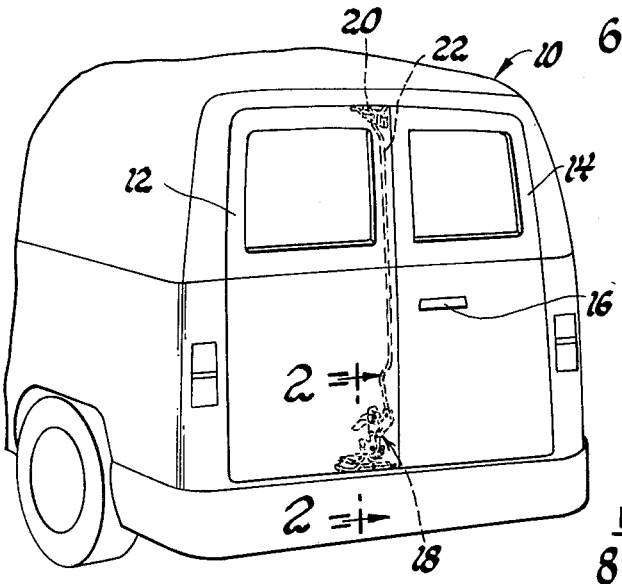
FIG. 1 is a partial rear view of a vehicle having one of the rear doors latched in closed position by the latch assembly of this invention shown in dash lines.

Referring to FIG. 1, a vehicle such as a van designated generally 10 has a pair of overlapping hinged doors, a first-closed left door 12 and an overlapping right door 14, both shown in closed position. Door 14 is held in closed position by a conventional latch assembly designated generally 16 and not further shown. Door 12 is held in closed position by a lower slide bolt latch assembly 18 according to this invention and an upper conventional detented fork bolt type latch assembly 20, the details of which are not further disclosed. A connecting rod 22 connects the latch assemblies 18 and 20 for concurrent operation.

Figure 3:
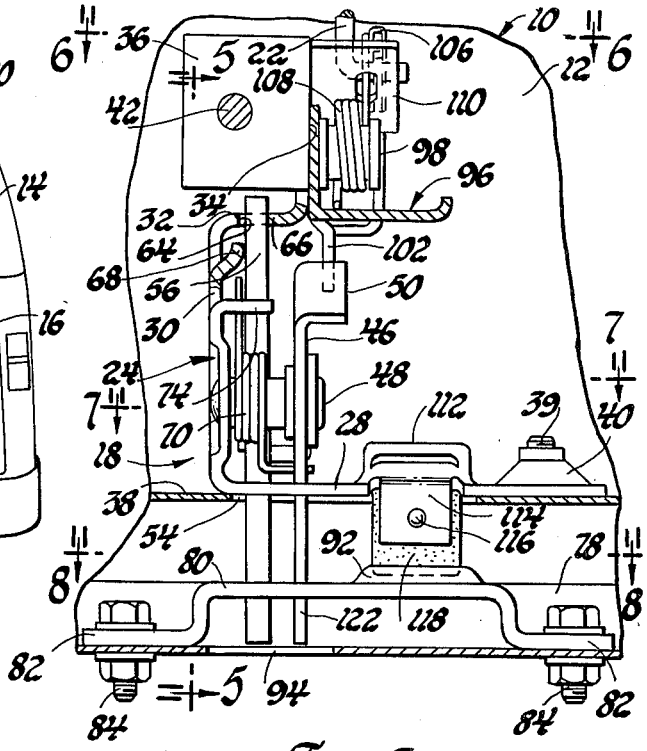
FIG. 3 is a view taken along the line 3—3 of FIG. 2.
Figure 2:
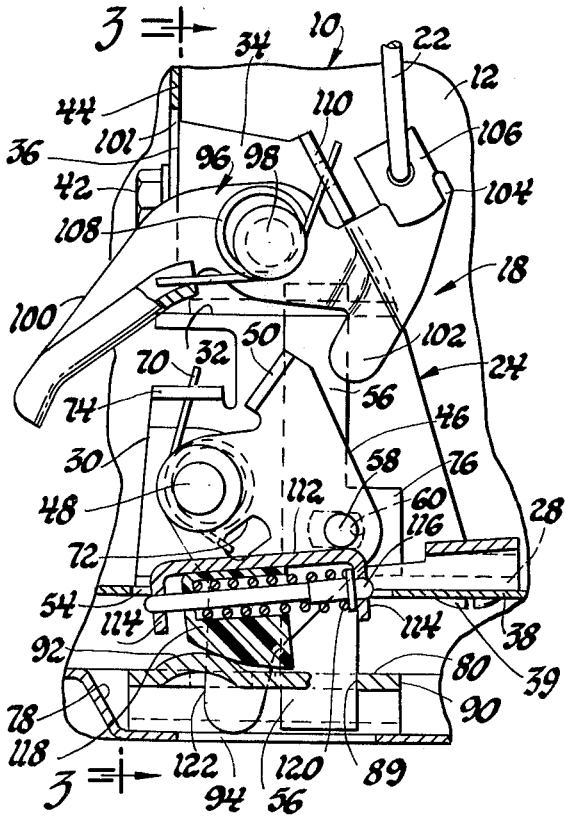
FIG. 2 is an enlarged sectional view taken along the line 2—2 of FIG. 1 and showing the latch assembly of the invention in latched position.
Figure 5:
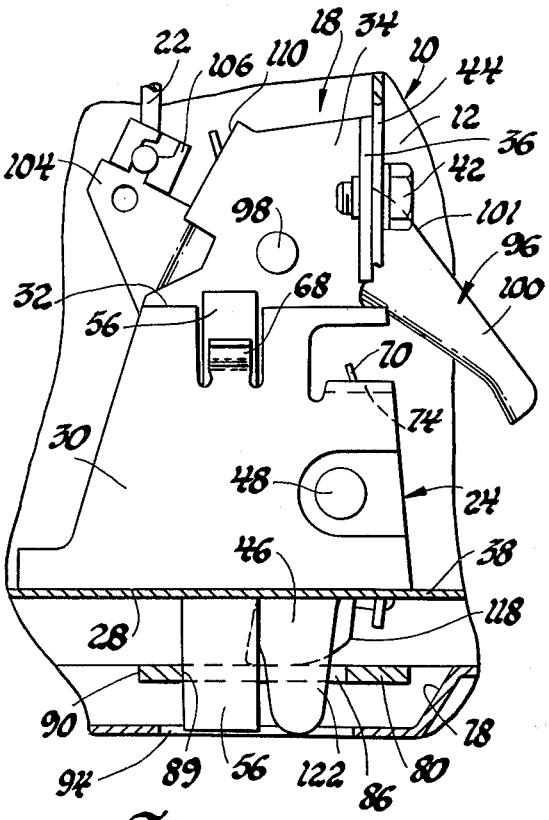
FIG. 5 is a view taken along the line indicated by line 5—5 of FIG. 3.
Figure 6:
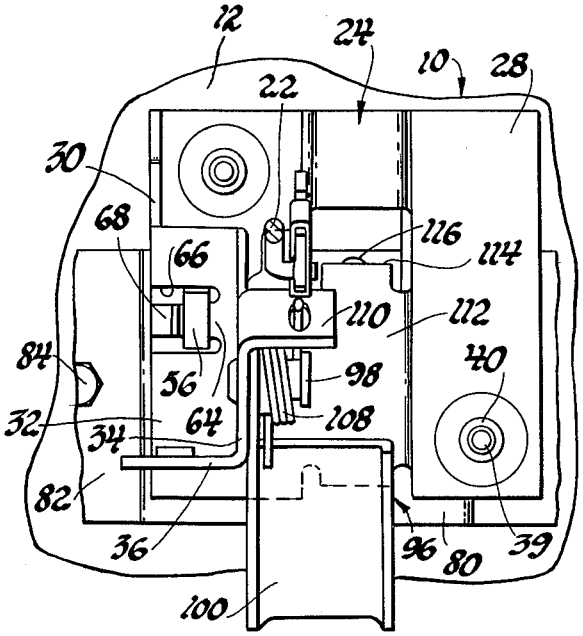
FIG. 6 is a view taken along the line indicated by line 6—6 of FIG. 3.
Figure 7:
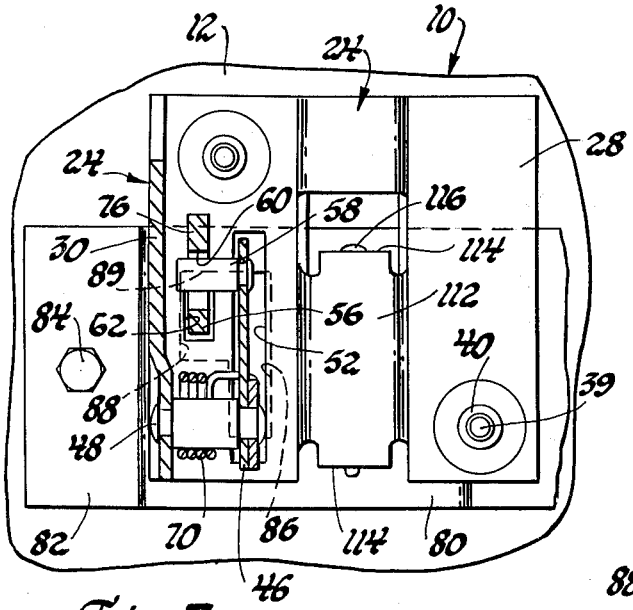
FIG. 7 is a view taken along the line indicated by line 7—7 of FIG. 3.
Figure 8:
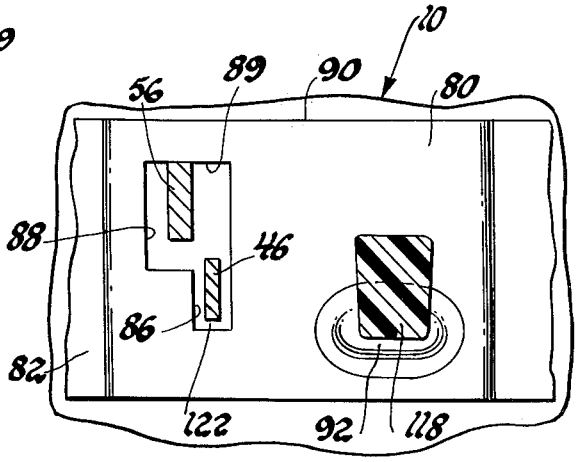
FIG. 8 is a view taken along the line indicated by line 8—8 of FIG. 3.

Referring to FIGS. 2, 3 and 5, the latch assembly 18 includes a frame designated generally 24 located within the lower corner of free swinging door 12. Frame 24 includes a base wall 28, a lower vertical side wall 30 generally perpendicular thereto, a horizontal wall 32 generally perpendicular to side wall 30, and an upper vertical side wall 34 offset from side wall 30 and having a lateral vertical flange 36. The base wall 28 is attached to lower wall 38 of door 12 by screws 39 which thread into a number of tapped embossments 40 of wall 28. In addition, a bolt 42 joins flange 36 to the inside wall 44 of door 12.

A cam lever designated generally 46 is attached by a shouldered pivot pin 48 to the side wall 30. This allows cam lever 46 to pivot between an extended position seen in FIGS. 2 and 3 and a retracted position seen in FIG. 5. A tab 50 extends approximately perpendicularly from cam lever 46 for a purpose described below. Cam lever 46 moves within slot 52 in wall 28 and also within an opening 54 in the lower wall 38 of door 12 which underlies base wall 28.

Referring to FIGS. 2 and 3, an elongated slide bolt 56 is attached to cam lever 46 by a pin 58 of the cam lever which is slidably captured in a transversely extending slot 60 of the slide bolt. As the cam lever 46 moves between extended and retracted positions, the movement of pin 58 in slot 60 moves the slide bolt 56 concurrently along a linear path between the FIG. 5 retracted position and the FIGS. 2 and 3 extended position. Slide bolt 56 is guided in this linear movement by a closely fitting rectangular slot 62, FIG. 4, in wall 28 and a rib 64 of a lanced slot 66, in horizontal wall 32, FIG. 3. A tab 68 holds the slide bolt 56 against rib 64 without binding.

A torsion spring 70 on pin 48 has one leg hooked in a slot 72 in cam lever 46 and the other leg engaged with a lanced, laterally extending tab 74 on side wall 30 and serves to continually bias cam lever 46 and, concurrently, slide bolt 56 toward their extended positions. A shoulder 76 on slide bolt 56 engages wall 28, FIG. 2, to limit this movement under the force of spring 70.

Figure 4:
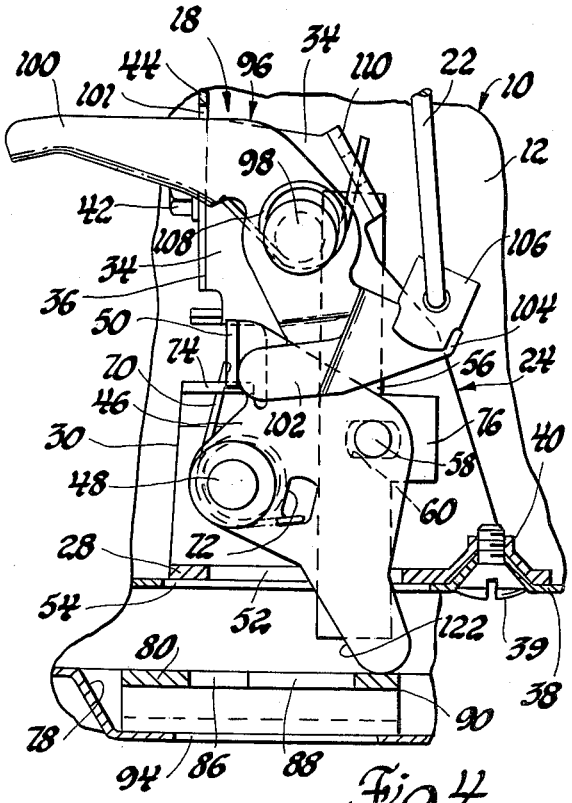
FIG. 4 is a view similar to FIG. 2, with parts removed for clarity and showing the door in partially open position.

Referring to FIGS. 2, 3 and 4, a depression 78 of the vehicle body sill opens outwardly of the vehicle and receives a striker plate 80. The legs 82 of the striker plate are secured to the base wall of the offset by bolts 84. A relatively longer slot 86 and relatively shorter slot 88 are integrally defined in striker plate 80 and open to each other. Slots 86 and 88 also open to slots 52 and 62 and respectively receive cam lever 46 and latch bolt 56 when door 12 is in the closed position. The slot 86 freely receives the cam lever 46 while the outer edge 89 of slot 88 is engaged by bolt 56 in extended position to hold door 12 in closed position, FIG. 2. Striker plate 80 has a web or leading edge portion 90 which forms the outer side of slots 86 and 88 and a raised rib 92, the purpose for which will be described later. Depression 78 has a hole 94 defined therein to prevent debris buildup under striker plate 80.

Referring to FIGS. 2 and 5, a release lever 96 is attached by shouldered pivot 98 to the side wall 34 for rotation between the position shown in FIG. 2 and that shown in FIG. 5. Release lever 96 includes a handle 100 extending inwardly of door 12 through an opening 101 in wall 44, a lower projection 102, and an upper offset flange 104. A clip 106 secures the lower end of connecting rod 22 to flange 104. A torsion spring 108 on pivot 98 has one leg hooked in an opening in a laterally extending tab 110 of side wall 34 and the other leg engaging handle 100. Spring 108 seats flange 104 against tab 110, FIG. 2, to normally locate release lever 96 in unactuated position.

Completing the construction of latch assembly 16, and referring to FIG. 2, a shallow rib 112 is stamped into wall 28 at an angle of approximately 10°. Rib 112 is then lanced to provide a pair of apertured tabs 114 which are approximately perpendicular to the surface of rib 112. A headed pin 116 extends between the tabs.

A nylon shoe 118 is slidably mounted on the pin 116. A compression spring 120 surrounds the pin 116 and seats between a bore in the nylon shoe and the head of the pin 116 to normally bias the nylon shoe inboard of the vehicle against the left hand tab 114, FIG. 2, and to also seat the head of the pin 116 on the right hand tab 114. The engagement of shoe 118 with rib 92 compresses spring 120 as the door is closed to exert an outward opening force on the door and engage slide bolt 56 with edge 89 of slot 88. The angle of pin 116 and the position of frame 26 relative to striker plate 80 are such that shoe 118 engages rib 92 as door 12 is closed so as to be positioned intermediate the tabs 114 and thereby vertically position door 12 relative to the sill of vehicle 10.

The operation of the invention can be understood by referring to FIGS. 2 and 5. FIG. 2 shows door 12 latched to the sill of vehicle 10 by the engagement of slide bolt 56 with the outer edge 89 of slot 88. This engagement is caused both by the spring force of the partially compressed spring 120 and the conventional seal pressure from the weather-stripping around door 12, not shown. Release lever 100 is maintained in unactuated position relative to tab 50 of cam lever 46. The detent of the fork bolt latch assembly 20 is connected to rod 22 as previously described and is in detented position. Cam lever 46 extends through slot 88 but is not involved in the latching of door 12 to the vehicle, this function being provided entirely by slide bolt 56.

After the operator has opened door 12 by operating latch assembly 16, the operator can reach behind door 12 and lift the release lever 96 to unlatch and open the door 12. When the release lever 96 is lifted or rotated clockwise in FIG. 2, projection 102 engages the tab 50 to rotate cam lever 46 counterclockwise from its FIG. 2 extended position to its FIG. 5 retracted position. This concurrently moves the slide bolt 56 to its FIG. 5 retracted position to unlatch the door 12 from the sill of vehicle 10. When the release lever 96 is rotated clockwise, it pulls the connecting rod 22 downwardly to release the detent from the fork bolt of the latch assembly 20 and thereby unlatch door 12 from the roof rail of vehicle 10. Once both latches are released, the reaction of shoe 118 against rib 92 under the force of spring 120 and the seal pressure moves the door 12 to partially open position whereupon the handle 100 is released. The spring 70 thereupon moves the cam lever 46 and the slide bolt 56 to their FIG. 2 extended positions while the spring 108 returns the release lever 96 to its unactuated position, FIG. 2. Thus, when the door is in the partially open position, the cam lever 46, the slide bolt 56 and the release lever 96 will be located in their positions as shown in FIG. 2.

When it is desired to close the door 12, the operator need merely push the door 12 toward closed position. As the door reaches a partially closed position, the leading edge 122 of the cam lever 46 engages the leading edge portion 90 of the striker plate 80 to rotate the cam lever 46 counterclockwise from its extended position as shown in FIG. 2 to its retracted position as shown in FIG. 5 and concurrently move the slide bolt 56 from its extended position of FIG. 2 to its retracted position of FIG. 5. As soon as the cam lever 56 has passed over the leading edge portion 90 of the striker plate 80, the spring 70 returns the cam lever 46 to its extended position and concurrently moves the bolt 56 to its extended position. The engagement of the shoe 118 with the rib 92 partially compresses the spring 120 so that the force of the partially compressed spring and the seal pressure engage the slide bolt 56 with the edge 89 of the slot 88 when the bolt moves to its extended position. The release lever 96 will move intermittently during closing movement of the door as the fork bolt of the latch assembly 20 ratchets past the detent thereof to intermittently move the rod 22 and in turn intermittently move the release lever.

Thus this invention provides an improved slide bolt latch assembly.

The embodiments of the invention in which an exclusive property or privilge is claimed are defined as follows:

1. A slide bolt latch assembly for releasably securing a door to a vehicle or the like comprising, a thin cam lever pivotally mounted on the door for movement between an extended position and a retracted position, the cam lever including a substantially linear leading edge, means biasing the cam lever toward its extended position, a thin slide bolt linearly movable between extended and retracted positions, means coupling the cam lever and the slide bolt for concurrent movement between extended and retracted positions, means locating the cam lever and slide bolt in their extended positions such that the slide bolt and cam lever leading edge are substantially parallel, striker means associated with the vehicle and having a leading edge portion and a second edge portion respectively engageable by the cam lever and slide bolt when in their extended positions, the leading edge portion being engageable by the cam lever leading edge as the door is partially closed to concurrently move the cam lever and slide bolt to their retracted position against the force of the biasing means, disengagement of the cam lever leading edge from the striker leading edge portion and subsequent movement of the cam lever to its extended position under the biasing means engaging the slide bolt with the second edge portion to maintain the door in closed position, and release means for concurrently moving the cam lever and slide bolt to their retracted position wherein the slide bolt is disengaged from the second edge of the striker means allowing the door to be opened.

2. In a vehicle or the like having a door movable between open and closed positions, a slide bolt latch assembly for releasably securing the door to the vehicle, comprising, a thin cam lever pivotally mounted to the door for movement between an extended position and a retracted position, the cam lever having a substantially linear leading edge, a thin slide bolt linearly movable between extended and retracted positions such that the slide bolt and cam lever leading edge are substantially parallel in extended position, pin and slot means interconnecting the slide bolt and cam lever, the slot means extending substantially perpendicular to the slide bolt, for concurrent movement between their respective extended and retracted positions, means biasing the cam lever and slide bolt concurrently toward their extended position, means locating the slide bolt and cam lever in their extended position under the force of the biasing means, striker means on the vehicle having first and second portions respectively engageable by the cam lever leading edge and slide bolt in their extended position, the first portion being engageable by the cam lever leading edge as the door is partially closed to rotate the cam lever about its pivot to its retracted position against the force of the biasing means, and concurrently moving the slide bolt linearly to its retracted position, disengagement of the cam lever leading edge from the first portion allowing the cam lever and slide bolt to move to extended position under the force of the biasing means and engaging the slide bolt with the second portion to maintain the door in fully closed position, and release means mounted on the door and selectively engageable with the cam lever to concurrently move the cam lever and slide bolt to retracted position wherein the slide bolt is disengaged from the second portion of the striker means permitting the door to be opened.

3. A slide bolt latch assembly for releasably securing a door to a vehicle or the like, comprising, a latch frame associated with the door, a cam lever member pivotally mounted to the frame for movement between an extended position and a retracted position, resilient means connected between the frame and the cam lever to bias the cam lever toward its extended position, a slide bolt member, cooperating linearly aligned slots on the frame for guiding the slide bolt along a linear path between an extended position and a retracted position, pin and slot means including a pin on one member slidably captured in a transversely extending slot in the other member to couple the members for concurrent movement between extended and retracted positions, the slide bolt member further including a shoulder thereon engageable with the frame to limit the movement of the slide bolt member and cam lever member toward their extended positions under the force of the resilient means, a striker plate associated with the vehicle and having respective slots therein for receiving the members, one slot having a leading edge engageable by the cam lever member as the door is partially closed to pivot the cam lever member to retracted position against the force of the resilient means and concomitantly move the slide bolt member to retracted position, disengagement of the cam lever member from the leading edge permitting the resilient means to move the cam lever and slide bolt to extended position within their respective slots and engaging the slide bolt with an edge of its respective slot to maintain the door in closed position, and a release lever pivotally mounted on the frame and engageable with the cam lever to concurrently move the cam lever and slide bolt to their retracted position to disengage the slide bolt from the edge of its respective slot allowing the door to be opened.

* * * * *